US006019248A

United States Patent [19]

Steinmayr et al.

[11] Patent Number: 6,019,248

[45] Date of Patent: Feb. 1, 2000

[54] DEVICE FOR MAKING AVAILABLE AND DELIVERING SACKS

[75] Inventors: Gerhard Steinmayr, Feldkirchen; Georg Wagner, Graz, both of Austria

[73] Assignee: Binder & Co Aktiengesellschaft, Gleisdorf, Austria

[21] Appl. No.: 09/062,249

[22] Filed: Apr. 17, 1998

[30] Foreign Application Priority Data

May 13, 1997 [AT] Austria ..... 811/97

[51] Int. Cl.[7] ..... B23Q 7/00

[52] U.S. Cl. ..... 221/174; 414/331.01

[58] Field of Search ..... 221/174, 92, 123; 414/331, 403, 331.01

[56] References Cited

FOREIGN PATENT DOCUMENTS 0 683 099 11/1995 European Pat. Off. .
31 47 653 6/1983 Germany .
31 51 760 7/1983 Germany .

*Primary Examiner*—Kenneth W. Noland

*Attorney, Agent, or Firm*—Collard & Roe, P.C.

[57] ABSTRACT

A device for making available and delivering sacks which can be supplied in hoppers (1). In order to allow a continuous removal of sacks it is provided that a substantially vertical guide chute (3) is provided whose at least one wall (16) is provided with a plurality of slots (15) extending mutually parallel and vertically, into which two lifting grates (4, 5) held vertically displaceable are laterally insertable and the hoppers (1) which are provided for receiving a stack of sacks (6, 7) are provided with bearing rods (2) whose mutual distance corresponds to the distance of the bridges between the slots (15) of the guide chute (3) or an integral multiple of the same and whose width corresponds maximally to the width of these bridges, with the height of the guide chute (3) exceeding three times the height of the hoppers (1) or the stack of sacks (6, 7) held in the same and the open clearance of the guide chute (3) exceeds the cross section of the hoppers (1) at least in the lowermost zone in which the hoppers (1) are insertable and in the case of a hopper (1) which is inserted in the guide chute (3) the bearing rods (2) of the same extend above the lower end of the slots (15) of the guide chute (3) between the same.

4 Claims, 6 Drawing Sheets

FIG. 7 a-h
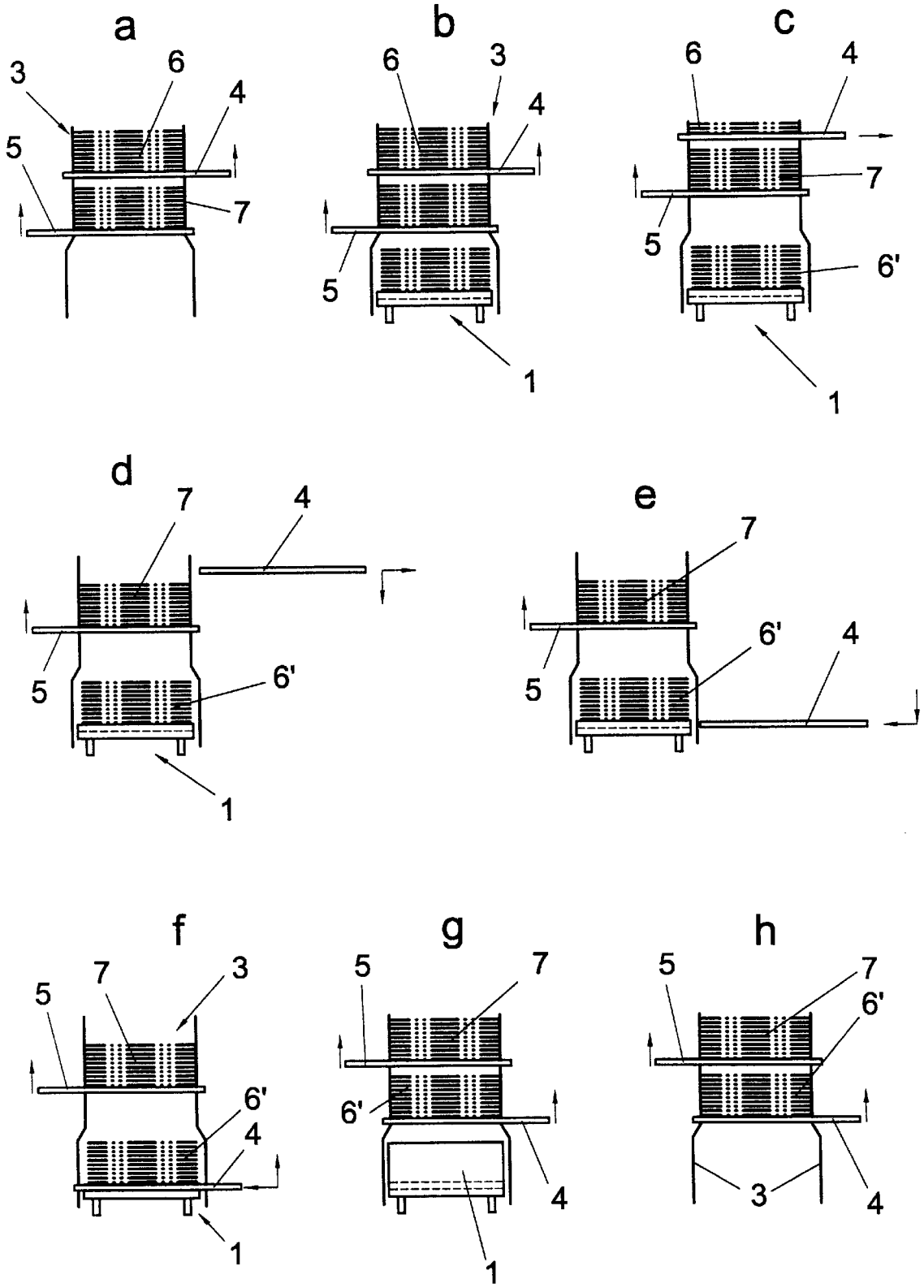

FIG. 7 j-p
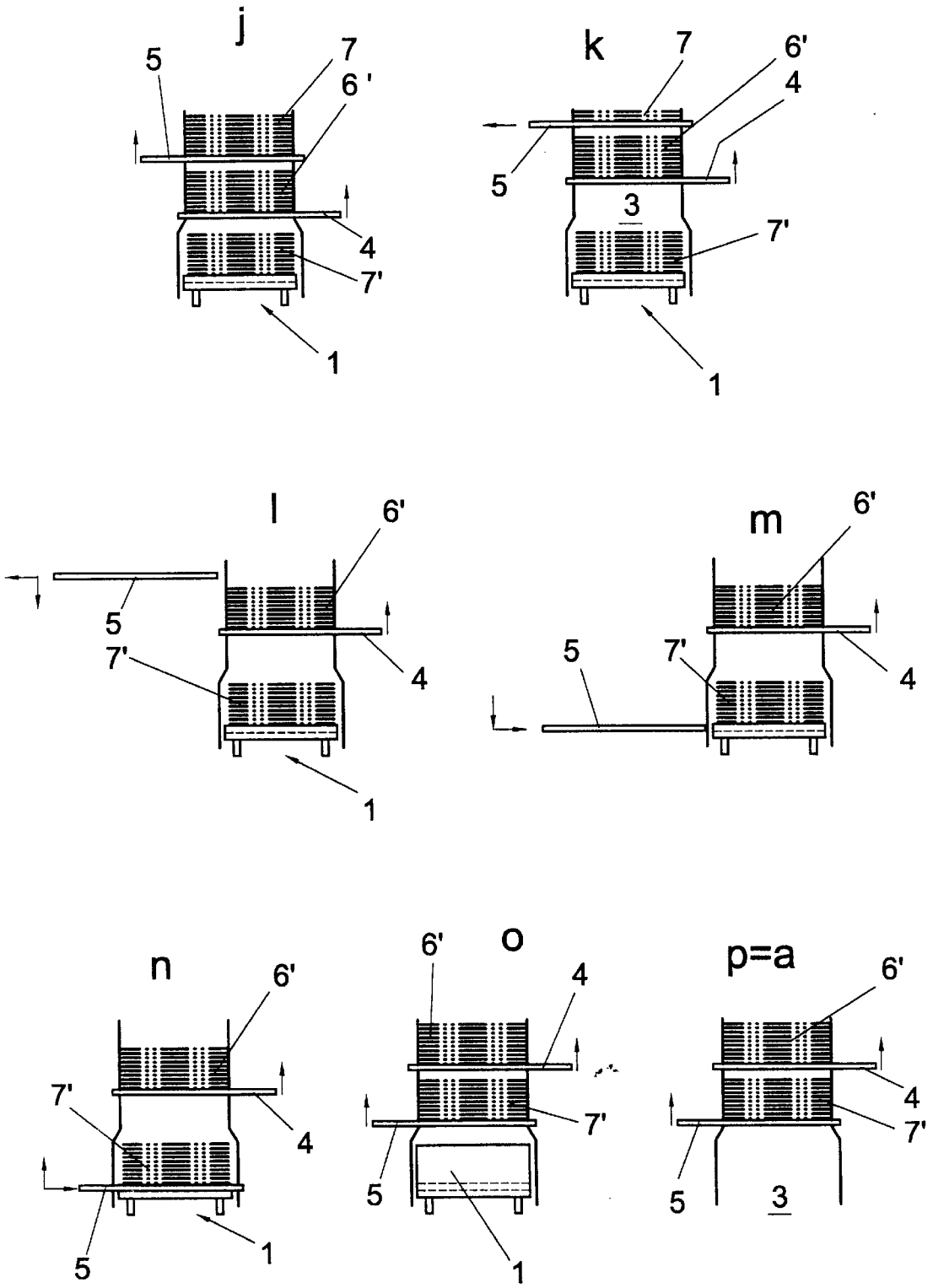

DEVICE FOR MAKING AVAILABLE AND DELIVERING SACKS

The invention relates to a device to make available sacks pursuant to the preamble of claim 1.

During the automatic filling of bulk material into empty sacks they are usually taken from a hopper and supplied to a filling device in the opened condition. In the known machines for this task the capacity of the hopper for receiving the sacks is either highly limited or the hopper devices are very complicated to fill. Accordingly, devices are known for example in which the sacks are rolled up on a spool in an imbricated manner.

In any case it is necessary after a relatively short operating period such as half an hour in simple hoppers, for example, where the sacks are simply stacked above one another or such as one hour in more complexly arranged hoppers to expect an interruption in the removal of the empty sacks so as to enable the exchange of the hoppers.

It is the object of the present invention to avoid such a disadvantage and to provide a device of the kind mentioned above which is characterized by a simple arrangement and allows a continuous operation of a filling unit.

This is achieved in accordance with the invention in a device of the kind mentioned above by the characterizing features of claim 1.

The proposed measures allow exchanging a hopper during the removal of the sacks, so that a continuous operation of a filling device is ensured.

The content of an individual hopper can be received by one of the two lifting grates and lifted into the upper removal position for the empty sacks. The lifting grates can be followed up during the removal. The content of a second hopper rests on the second lifting grate.

If only a few sacks rest on the upper lifting grate it can laterally be pulled out from the guide chute and, in the case of a hopper inserted in the lowermost zone of the guide chute, it can be inserted into the lowermost zone of the guide chute and of the hopper that is inserted into the same, and thereafter lifted, whereupon the hopper can be pulled out of the guide chute again.

In this way it is possible to easily secure a continuous operation of a filling device and a continuous removal of sacks.

The features of claim 2 lead to a simple solution in a constructional respect, because the two lifting grates need not be guided past one another which would otherwise lead to a relatively complex sequence of movements in the transfer of a lifting grate from its uppermost position to its lowest position.

The features of claim 3 lead to the advantage of a secure guidance and fixing of a stack of sacks in a hopper. Principally, however, a hopper could be reduced to a supporting grate whose bars of the grate are arranged at a higher level than the bearing plane of the supporting grate or hopper, so that the bars of the lifting grate can move below the supporting plane of the stack and can lift the same.

The features of claim 4 allow the easy handling of the hoppers.

The invention is now explained in closer detail by reference to the enclosed drawings, wherein.

Figure 5:
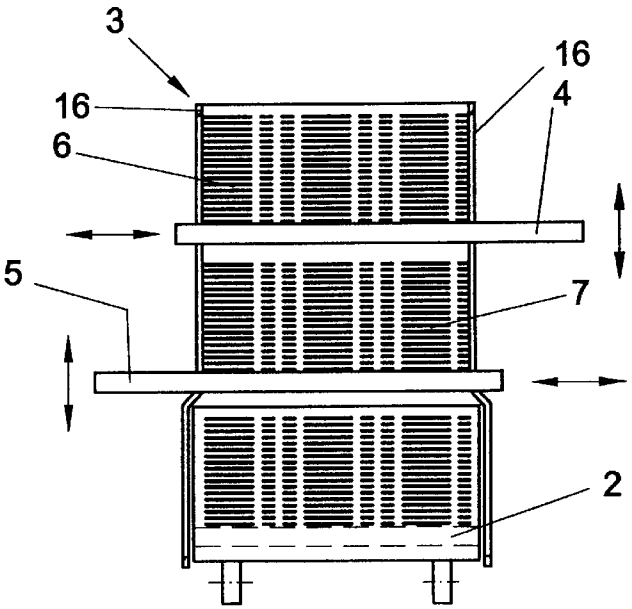
Figure 6:
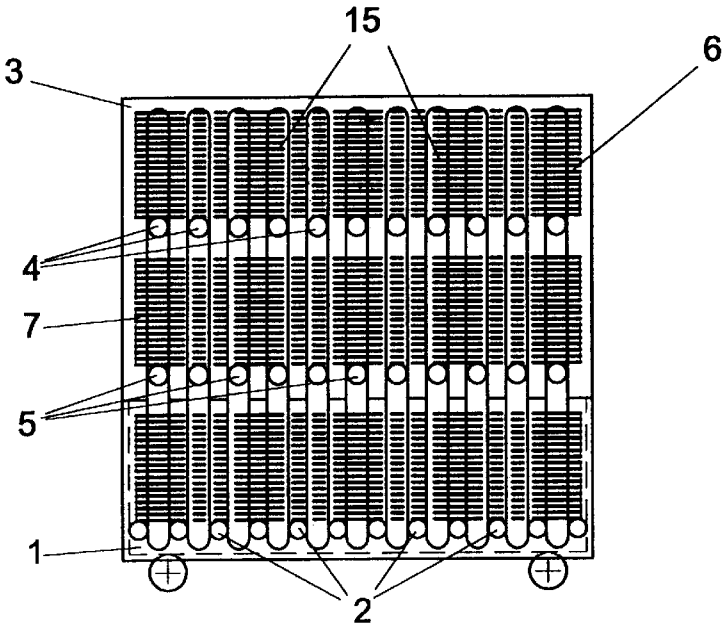
Figure 2:
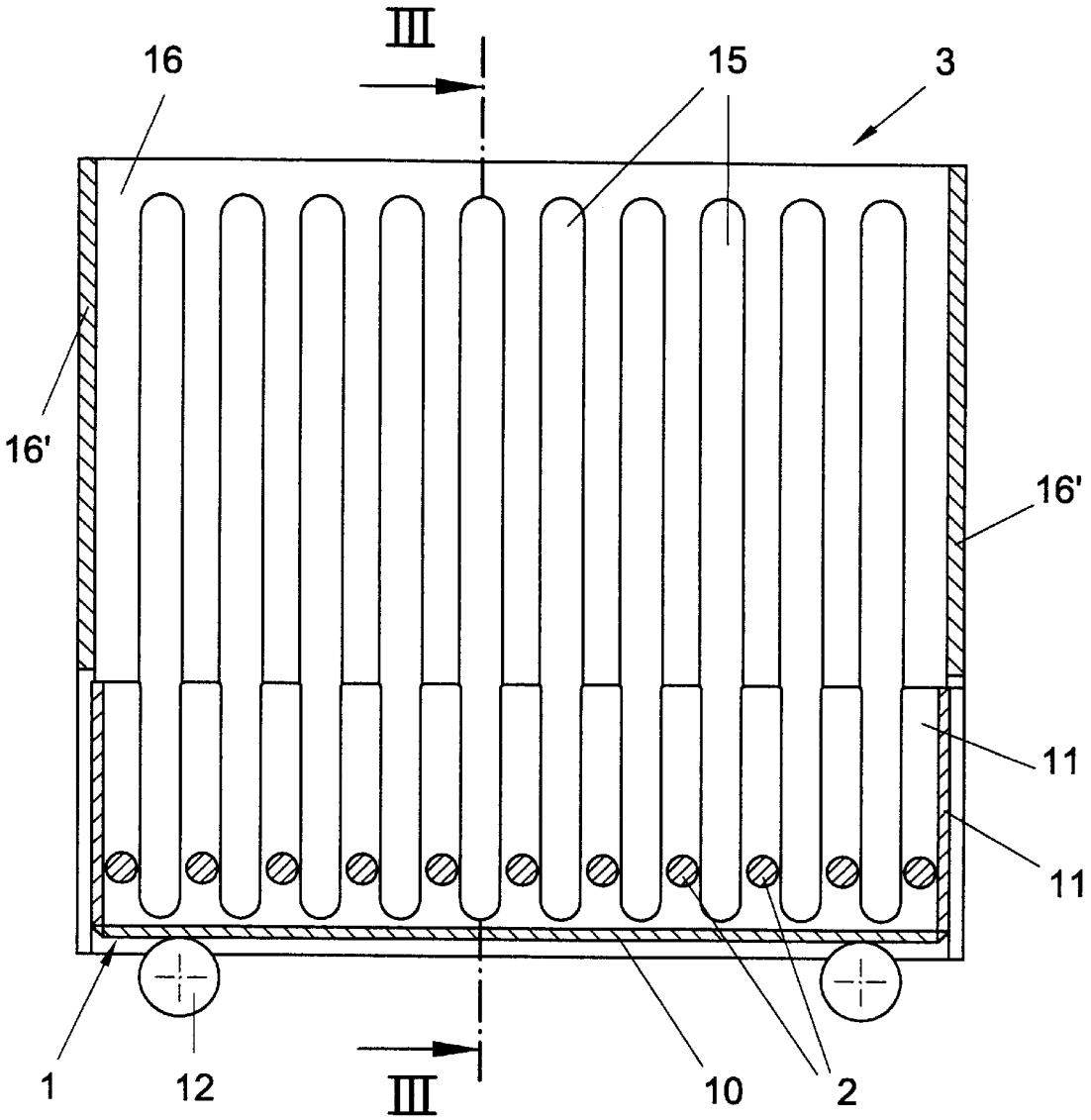
FIG. 2 shows a sectional view through a guide chute with an inserted hopper.
Figure 3:
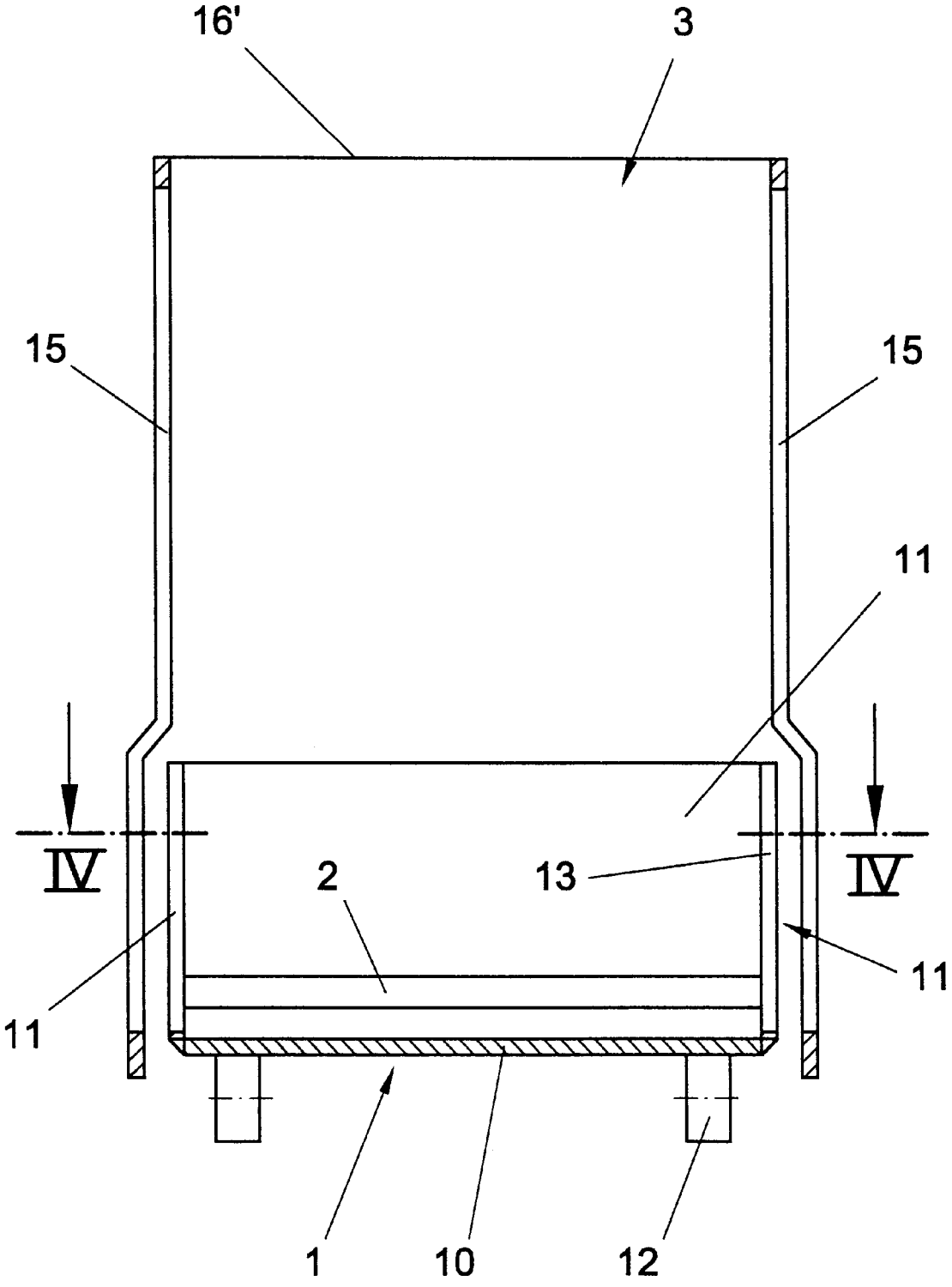
FIG. 3 shows a sectional view along line III—III in FIG. 2.
Figure 4:
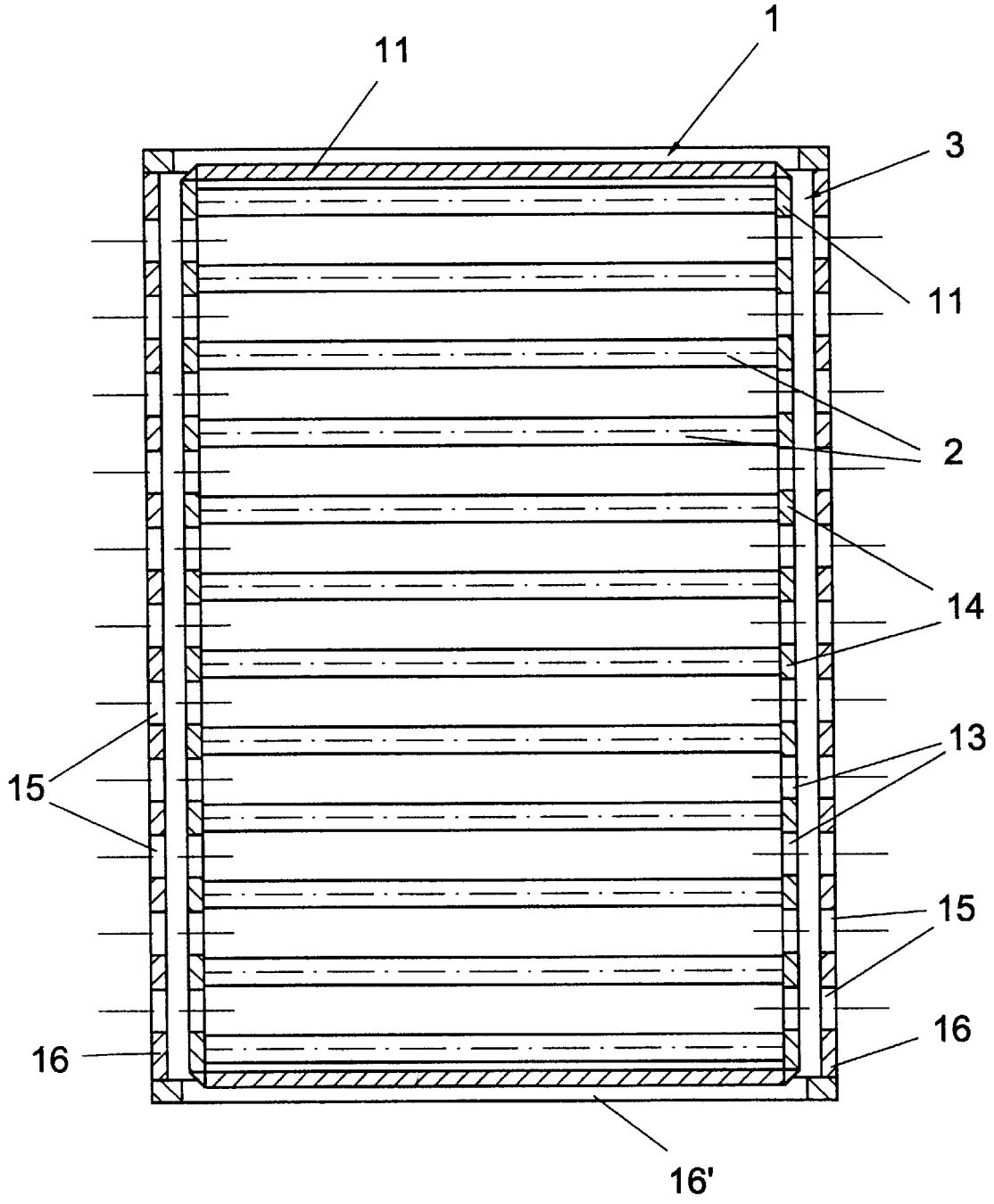
FIG. 4 shows a sectional view along line IV—IV in FIG. 3.

FIG. 5 schematically shows a sectional view similar to the one according to FIG. 3 through a device in accordance with the invention which is in operation;

FIG. 6 schematically shows a sectional view similar to the one according to FIG. 2 through a device in accordance with the invention which is in operation and FIGS. 7*a* to 7*p* schematically show the individual phases of a complete change of hopper.

Figure 1:
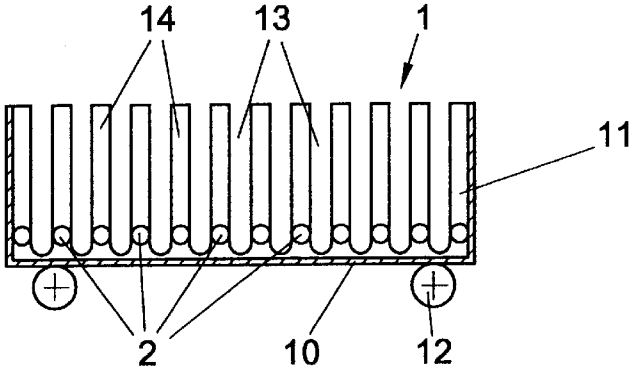
FIG. 1 shows a sectional view through a hopper.

As is shown in FIG. 1, a hopper 1 is provided with a floor 10 from which side walls 11 project upwardly. Wheels 12 are provided further.

Two mutually opposite side walls 11 of the hopper 1 are provided with slots 13 which are open in their upper edge. Bearing rods 2 are held in the lower zone of the bridges 14 which remain between said slots 13, which bearing rods extend into the interior of hopper 1. The bearing rods 2 are arranged above the plane of the lower ends of the slots 13 and form a support for a stack 6, 7 of sacks.

As is shown in FIGS. 2 and 3, the device in accordance with the invention is provided with a guide chute 3. This guide chute is provided with two mutually opposite side walls 16 with slots 15 whose distance from one another and whose width substantially correspond to those of slots 13 in hopper 1. However, in the represented embodiment these slots 15 are arranged as breakthroughs and are therefore provided with a closed circumference.

In the lowermost zone of the guide chute 3 the side walls 16 of the guide chute 3 which are provided with the slots 15 are outwardly bent, thus resulting in a larger open clearance in this zone. This zone lacks at least one face wall 16', and in the illustrated example it lacks both face walls 16', so that a hopper 1 can be inserted in this zone. The open clearance of the lowermost zone of the guide chute 3 exceeds the cross section of hopper 1. The height of the guide chute 3 exceeds three times the height of a stack 6, 7 of sacks held in a hopper 1 (FIGS. 5, 6).

As is shown from FIGS. 5 and 6, lifting grates 4 and 5 are provided on either side of the guide chute 3, with the freely ending grate bars of said lifting grates being insertable into the slots 15 of the guide chute 3. These lifting grates 4, 5 are movable in the horizontal and vertical directions.

As is shown from FIG. 7, stacks 6, 7 of sacks are deposited on each of the two lifting grates 4, 5 (FIG. 7*a*), with the lifting grates 4, 5 slowly travelling upwardly and with the uppermost sacks being removed with a removal apparatus (not shown) such as an arm provided with a suction means. Once the lower lifting grate 4, 5 has been lifted above the height of a hopper 1, such a hopper can be inserted into the lowermost zone of the guide chute 3 (FIG. 7*b*).

As soon as only few sacks of the stack 6 rest on the uppermost lifting grate 4 (FIG. 7*c*), it is pulled laterally out of the guide chute 3 and the sacks fall onto the stack 7 situated underneath. Any entrainment of these sacks during the withdrawal of the lifting grate 4 is not possible owing to the parts of the side wall 16 which remain between the slots 15 of the side wall 16 of the guide chute 3 (FIG. 7*d*).

Thereafter the retracted lifting grate 4 is lowered (FIG. 7*e*) and re-inserted into the lower zone of the guide chute 3 (FIG. 7*f*). In this process the grate bars of the lifting grate 4 below the bearing rods 2 of the inserted hopper 1 are also inserted into the same and therefore move below the stack 6' which therefore also rests on the bearing rods 2 of hopper 1 and is lifted by the grate rod 4 (FIG. 7*g*).

Thereafter the hopper 1 can be pulled out of the guide chute 3 again (FIG. 7*h*) and a new hopper 1 can be inserted (FIG. 7*j*).

Once nearly all sacks of stack 7 are removed the lifting grate 5 is pulled laterally out of the guide chute 3, so that the remaining sacks fall onto stack 6' which is held by grate rod 4 (FIGS. 7*k* and 7*l*).

The lifting grate 5 is then lowered (FIG. 7*m*) and is inserted in the lowermost zone of the guide chute 3 into the same and into the provided hopper 1, with the slots 15 of the guide chute 3 and the slots 13 of the hopper 1 being penetrated (FIG. 7*n*).

After the lifting of the lifting grate 5 above the height of the hopper 1, with the lifting grate 5 coming out of engagement with the hopper 1, (FIG. 7*o*) the hopper 1 can be removed from the guide chute. In this process the sacks are removed from stack 6' which is held by the lifting grate 4. This leads to the same situation as is known from FIG. 7*a* (FIG. 7*p*).

It is therefore possible to remove sacks continuously from the uppermost region of the guide chute 3 without having to interrupt the removal at times when the hopper is changed.

We claim:

1. A device for making available and delivering sacks which can be supplied from hoppers (1), characterized in that a substantially vertical guide chute (3) is provided whose at least one wall (16) is provided with a plurality of slots (15) extending mutually parallel and vertically, into which two lifting grates (4, 5) held vertically displaceable are laterally insertable and the hoppers (1) which are provided for receiving a stack of sacks (6, 7) are provided with bearing rods (2) whose mutual distance corresponds to the distance of the bridges between the slots (15) of the guide chute (3) or an integral multiple of the same and whose width corresponds maximally to the width of these bridges, with the height of the guide chute (3) exceeding three times the height of the hoppers (1) or the stack of sacks (6, 7) held in the same and the open clearance of the guide chute (3) exceeds the cross section of the hoppers (1) at least in the lowermost zone in which the hoppers (1) are insertable and in the case of a hopper (1) which is inserted in the guide chute (3) the bearing rods (2) of the same extend above the lower end of the slots (15) of the guide chute (3) between the same.

2. A device as claimed in claim 1, characterized in that the lifting grates (4, 5) are insertable from different sides into the slots (15) of the guide chutes (3), which slots are arranged in true alignment at two mutually opposite walls (16) of the guide chute (3).

3. A device as claimed in claim 1, characterized in that the hoppers are provided with side walls (11) of which two mutually opposite side walls (11) are provided with vertically extending slots (13) which are open at their upper edge and whose distances and widths correspond to those of the guide chute (3) and the bearing rods (2) are provided in the zone of the bridges (14) between the slots (13) and above their lower ends.

4. A device as claimed in claim 1, characterized in that the hoppers (1) are provided with rolls (12).

* * * * *